United States Patent [19]

Adams

[11] 4,177,709

[45] Dec. 11, 1979

[54] MOUNTING FOR TWO PAIRS OF CYMBALS

[76] Inventor: Michael E. Adams, 6409 N. Newgard, Chicago, Ill. 60626

[21] Appl. No.: 946,740

[22] Filed: Sep. 29, 1978

Related U.S. Application Data

[63] Continuation-in-part of Ser. No. 924,998, Jul. 17, 1978.

[51] Int. Cl.[2] ..... G10D 13/06

[52] U.S. Cl. ..... 84/422 R; 84/402; 84/421

[58] Field of Search ..... 84/422 R, 402, 403, 84/421

[56] References Cited

U.S. PATENT DOCUMENTS

| | | | |
|---|---|---|---|
| 3,167,995 | 2/1965 | La Londe | 84/421 |
| 4,111,095 | 9/1978 | Simons | 84/422 R |

FOREIGN PATENT DOCUMENTS

| | | | |
|---|---|---|---|
| 565460 | 11/1944 | United Kingdom | 84/422 |

*Primary Examiner*—John Gonzales
*Assistant Examiner*—Shelley Wade
*Attorney, Agent, or Firm*—Robert E. Wagner; Thomas L. Kautz

[57] ABSTRACT

A foot operated percussion musical instrument is provided by the present invention in which two pairs of cymbals are mounted in an adjustable framework one above the other, and are movable in unison by operation of a single foot pedal.

25 Claims, 9 Drawing Figures

MOUNTING FOR TWO PAIRS OF CYMBALS

The present application is a continuation-in-part of my earlier filed application, Ser. No. 924,998, filed July 17, 1978, now pending.

BACKGROUND OF THE INVENTION

This invention relates generally to musical instruments, and more specifically, to a foot operated cymbal assembly having two pairs of cymbals disposed on variable proximity, one above the other, within an adjustable framework, mounted on a telescoping main support shaft, both pairs of cymbals being movable to simultaneously clash by operation of a single foot pedal.

The apparatus of the present invention is related to the percussion musical instrument commonly referred to as a "hi-hat", which has long been used by percussionists. The "hi-hat" is characterized by two cymbals disposed a small distance one above the other in a facing relationship at the end of an elongated shaft held upright by legs. The lower cymbal is fixed and the upper cymbal movably fixed on a pole, which is spring biased to maintain the cymbals in a normally spaced apart or open position.

As is well known, the hi-hat may be used to produce a number of distinctively different sounds. In an "open" position where the upper and lower cymbals are spaced apart, the upper cymbal vibrates for an extended period of time when struck. By contrast, a distinctive dampened sound is produced as the upper and lower cymbals contact one another when the foot pedal is depressed. If the pedal is depressed quickly but released immediately upon contact of the two cymbals, a bright, scraping "ching" sound is produced. Finally, when the upper cymbal is disengaged from the pull rod it is normally attached to and is allowed to rest upon the lower cymbal, a very "splashy" sound is produced if the cymbals are struck with a drumstick, brush or the like.

A limitation of known hi-hat cymbal devices is that only one set of cymbals are provided, and the percussionist is thus restricted in the variety and complexity of sounds attainable with either one or two sticks while playing the hi-hat alone or in conjunction with the other selected pieces of the drum set. The unique arrangement of four cymbals provided by the present invention greatly increases the versatility and distinctiveness of sound which may be produced, as compared to existing hi-hat cymbal devices, and allows for experimentation with heretofore unrealized rhythmic patterns and tonal blends on an otherwise conventional drum set.

SUMMARY OF THE INVENTION

The present invention provides an upper and lower set of cymbals mounted one above the other in an adjustable frame wherein a pulley system is provided to open and close the upper set of cymbals in unison with the lower set by operation of a single foot pedal. The two pairs of cymbals can be disposed in close proximity within the frame, so that the percussionist may alternately strike the upper and lower pairs of cymbals in a continuous motion using conventional drumstick technique. By providing a striking surface at both ends of the drumsticks' range of motion, the present invention allows a percussionist to play as many strokes at a given speed with one hand as would require two hands on a traditional hi-hat device. Since he will literally be able to do the work of two hands with only one, the drummer will have at his disposal an "extra" limb with which to play the other pieces of a drum set.

Therefore, it is an object of the present invention to provide a cymbal apparatus having a pair of upper and lower cymbals disposed within an adjustable frame which is provided with a pulley means operable to move the upper pair of cymbals in unison with the lower pair of cymbals by depressing a single foot pedal.

It is another object of the present invention to provide a pulley system disposed about the circumference of the frame, which is operable with the foot pedal to operate the upper twin cymbals in unison with the lower twin cymbals.

It is another object of the present invention to provide a cymbal apparatus having an upper and lower pair of cymbals within an adustable framework which, when collapsed, positions the cymbals in close enough proximity to allow for rapid alternate striking of both pair of cymbals in a continuous motion utilizing conventional drumstick technique.

It is a further object of the present invention to provide a cymbal apparatus in which the upper set of cymbals are adjustable to remain apart as the foot pedal is depressed while the lower set of cymbals contact one another, thus providing two upper free hanging cymbals in variable proximity within the framework to the pair of lower contacting cymbals.

It is a still further object of the present invention to provide a framework to support the upper and lower sets of cymbals, which is adjustable to vary the distance therebetween.

BRIEF DESCRIPTION OF THE DRAWINGS

Objects in addition to the foregoing will become apparent upon consideration of the following description taken in conjunction with the accompanying drawings wherein.

DETAILED DESCRIPTION OF THE INVENTION

Figure 1:
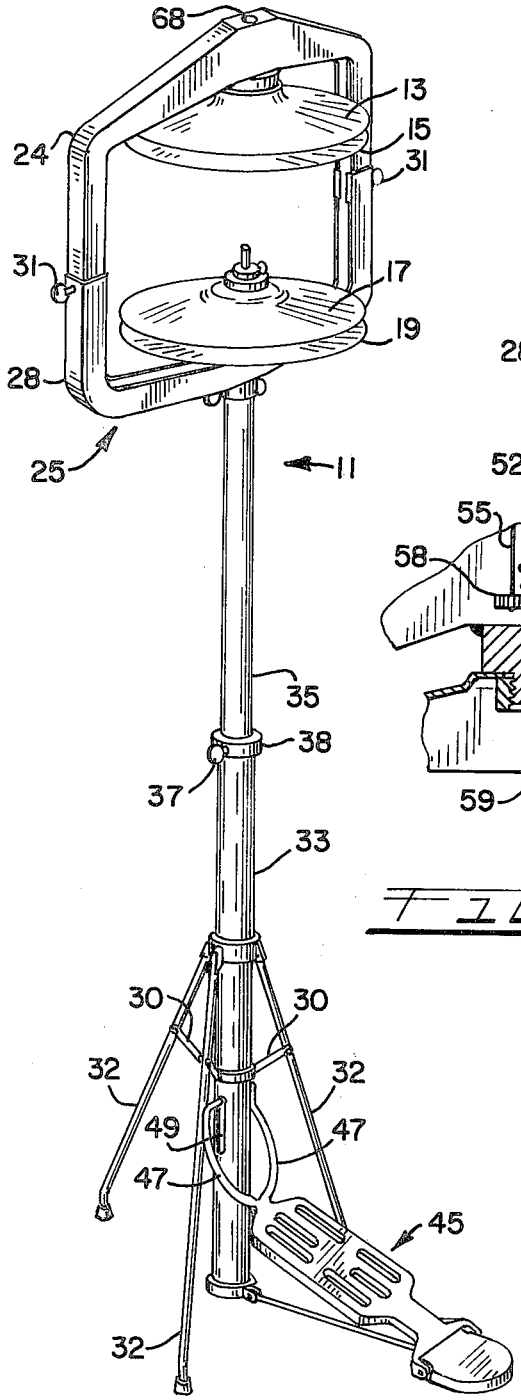
FIG. 1 is an overall perspective view in full elevation of the apparatus of the present invention.

Referring now to the drawings, and in particular to FIG. 1, the cymbal apparatus of the present invention is labeled with reference numeral 11. The cymbal apparatus 11 includes a pair of upper twin cymbals 13 and 15 and a pair of lower twin cymbals 17 and 19 which are disposed one pair above the other in a hollow frame 25.

Frame 25 consists of a top section 24 and a bottom section 28 which are generally U-shaped. The top section 24 is of a slightly smaller diameter than bottom section 28, and is movable therewithin a distance approximately equivalent to the leg portion of the U-shape. A thumb screw 31 is threaded through an opening in each leg of bottom section 28 to engage top section 24 and hold it firmly in place at selected positions therealong.

As discussed below, upper twin cymbals 13 and 15 are mounted on top section 24 and lower twin cymbals 17 and 19 are disposed adjacent bottom section 28. Thus, the distance between the upper and lower twin cymbals may be adjusted as desired by releasing thumb screws 31 and moving top section 24 to a selected position within bottom section 28. By moving the top section 24 of frame 25 toward bottom section 28, the upper twin cymbals 13 and 15 may be spaced a short distance from the lower twin cymbals 17 and 19 within frame 25. This places a striking surface at either end of the drum stroke enabling the percussionist to alternately strike the upper and lower pairs of cymbals in a continuous motion to produce twice as many "hits" per stroke as could be played on conventional hi-hat devices. The drummer can play as many strokes at a given speed with one hand using the present invention, as could be played with two hands on known hi-hat cymbal devices. The other hand is thus free to play the snare, tom-toms or other instruments of the drum set with the unique four-cymbal arrangement of the present invention, to produce sound combinations not previously attainable with existing hi-hat devices.

Figure 2:
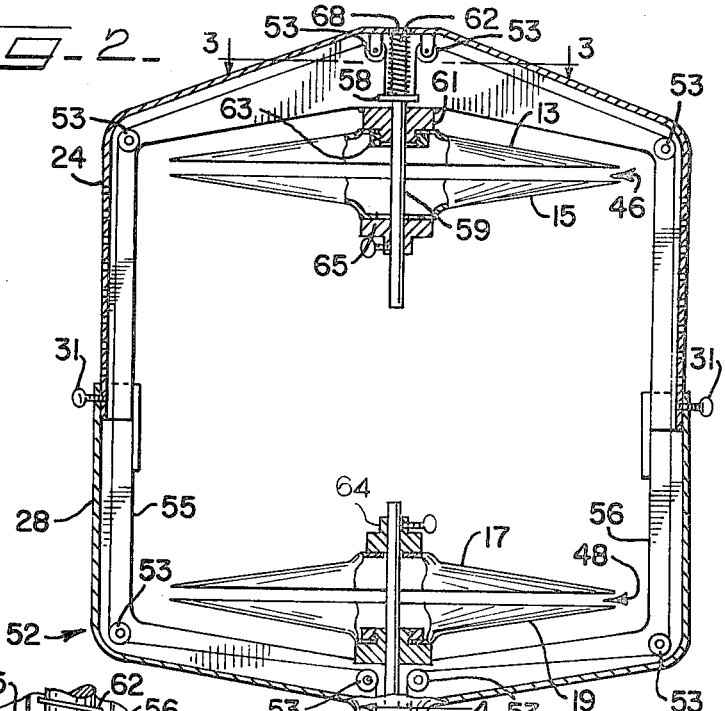
FIG. 2 is a cross sectional view in full elevation of the apparatus of the present invention, showing the pulley system for moving the upper pair of cymbals, the mounting means for the lower pair of cymbals, and the adjustable support means of the cymbal frame and stand.

Referring now to FIG. 2, frame 25 is mounted by means of thumb screws 31 to a cymbal stand 29 which is supported in an upright vertical position by at least three collapsible legs 32. Legs 32 are hinged at a point along stand 29 so that they may be folded upwardly therealong as shown in dotted lines in FIG. 2, for compact storage of stand 29 when not in use. Struts 20 extend outwardly from stand 29 and attach to legs 32 in their extended position to hold them in a fixed position.

Figure 3:
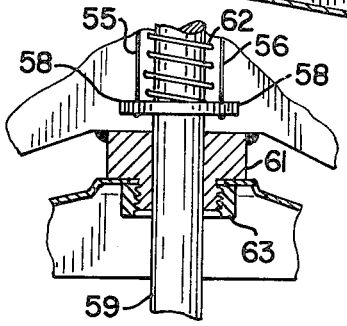
FIG. 3 is a partial cross sectional view taken generally along line 3—3 of FIG. 2 showing the connection of the pulley system to the upper shaft for movement of the lower one of the upper twin cymbals.
Figure 3:
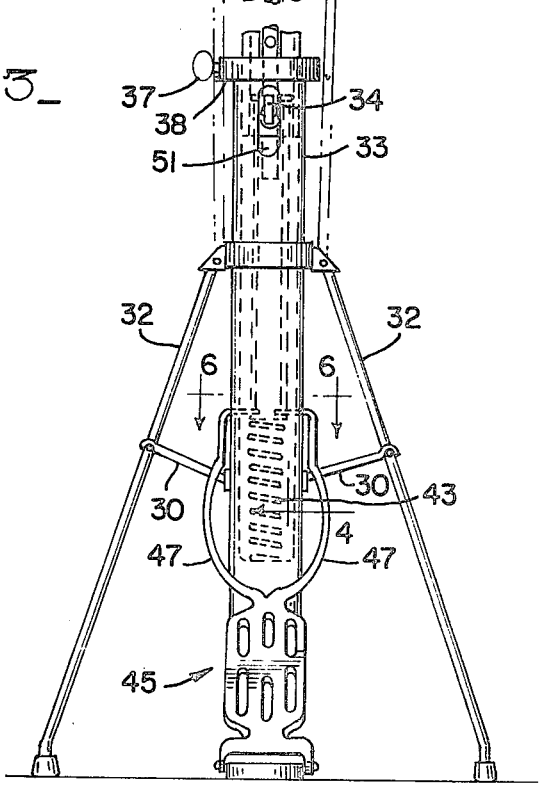

Referring now to FIGS. 2 and 3, a means of adjusting the height of frame 25 itself is shown. Stand 29 includes a hollow housing 33 in which a shaft 35 of smaller diameter is inserted for movement therewithin. Frame 25 is formed with a truncated stem 26 on its lower end which is removably fitted over the uppermost portion of shaft 35. Thumb screws 31 are threaded through openings on either side of stem 26 and contact shaft 35 to secure frame 25 tightly thereto. Frame 25 may be easily removed from shaft 35 to transport and storage by loosening screws 31. The height of frame 25 is adjusted by a wing nut 37 which is threaded into a collar 38 mounted on housing 33, and extends into contact with shaft 35 to hold it securely in position within housing 33 at the desired height of frame 25.

Figure 4:
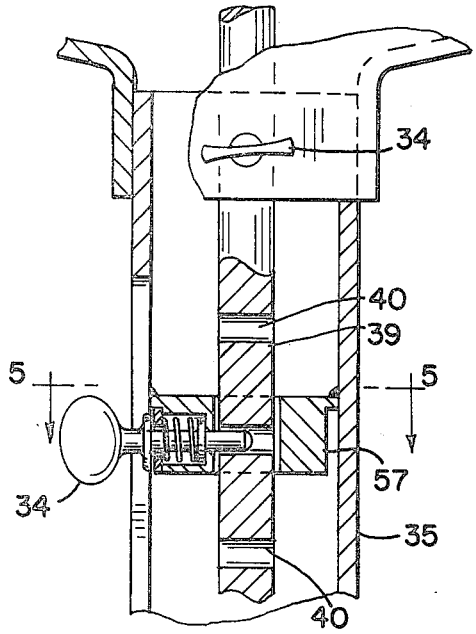
FIG. 4 is a partial cross sectional view taken generally along line 4—4 of FIG. 2, showing the means for adjusting the height of the cymbal framework, the biasing-means supporting the lower set of cymbals, and the cable adjustment means.
Figure 5:
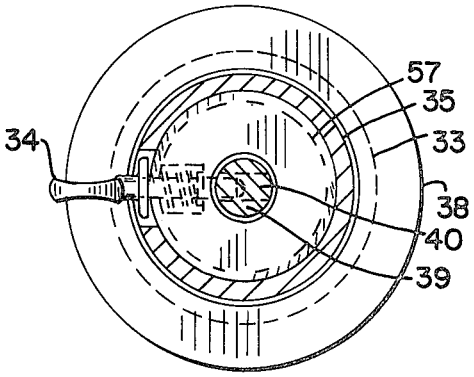
FIG. 5 is a cross sectional view taken generally along line 5—5 of FIG. 3 showing the attachment of the spring-biased turn key to the cable adjustment means.
Figure 5:
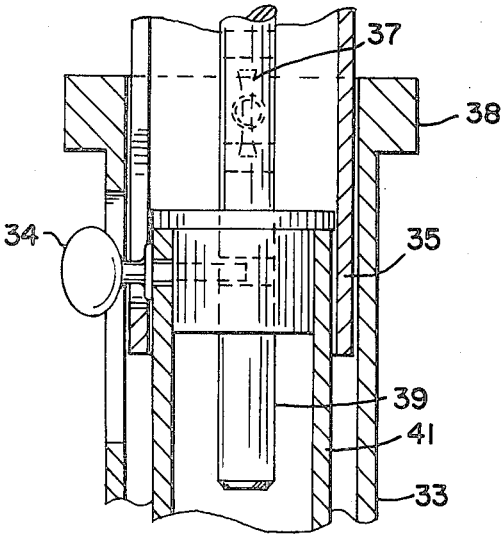
Figure 6:
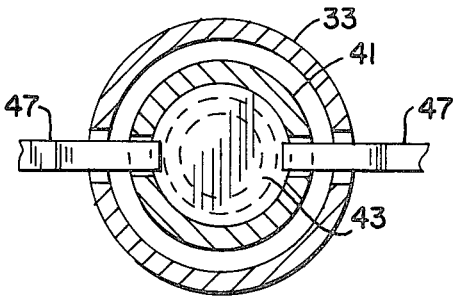
FIG. 6 is a cross sectional view taken generally along line 6—6 of FIG. 2 showing the foot pedal arms attaching to the lower cymbal support rod for movement therewith.
Figure 6:
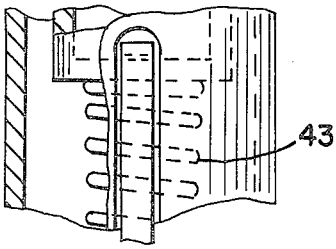

Lower twin cymbals 17 and 19 clash together by the operation of a foot pedal 45 which communicates with cymbal 17 through a tube 41 and a movable rod 39 (see FIG. 4). Tube 41 is disposed within housing 33, and attaches at one end to a helical spring 43 which constantly urges tube 41 upwardly from the base of housing 33. A movable rod 39, formed with a plurality of spaced bores 40, is disposed in shaft 35 and extends upwardly to a point within frame 25 where a collar 64 attaches cymbal 17 thereto as shown in FIG. 2. The lower end of rod 39 and the upper or free end of tube 41 are ganged together for unitary movement by means of a turn key 34 which is inserted through an opening in tube 41 and into a bore 40 of rod 39.

Pedal 45, tube 41 and rod 39 cooperate to cause cymbal 17, removably attached to rod 39, to contact cymbal 19. Foot pedal 45 is provided with arms 47 extending upwardly therefrom. Housing 33 is formed with slots 49 through which the free end of arms 47 extends and attach to tube 41. As the foot pedal 45 is depressed, arms 47 move downwardly along slots 49 causing tube 41, and rod 39 attached thereto, to move cymbal 17 into contact with cymbal 19, which is removably mounted in a fixed position on frame 25. As is well known, contact between cymbal 17 and fixed cymbal 19 produces an abbreviated or shortened "chick" sound, as the vibrations of cymbals 17 and 19, when brought together by pedal 45, are dampened. This distinctive sound is in contrast to the ringing sound produced by striking cymbals 17 and 19 in an open position, as when pedal 45 is released and spring 43 uncoils to return tube 41 and rod 39 to their extended positions in which cymbals 17 and 19 are a short distance apart. As shown in FIG. 2, a slot or opening 51 is provided in housing 33 to allow turn key 34, which secures tube 41 and rod 39 together, to move downwardly along housing 33 with the depression of pedal 45.

Known types of so-called hi-hat cymbals generally operated in a manner similar to that of cymbals 17 and 19 as discussed above. The present invention, however, provides a second pair of cymbals 13 and 15 disposed directly above cymbals 17 and 19 within frame 25, which may be adjusted to open and close together simultaneously with lower twin cymbals 17 and 19. This novel arrangement permits the percussionist to create special effects and combinations of sound not presently obtainable with existing cymbal apparatus.

As one alternative, upper twin cymbals 13 and 15 may be adjusted to remain apart while lower twin cymbals 17 and 19 contact one another, as foot pedal 45 is depressed. This provides the percussionist with a conventional hi-hat cymbal arrangement using cymbals 17 and 19 to produce a short, abbreviated sound when closed, in variable proximity within frame 25 to a free hanging cymbal 15, which produces a long ringing sound when struck. Another alternative is afforded the drummer if he simply loosens the set screw in collar 64 with which lower cymbal 17 is fixed to pull-rod 39. By so doing, he will be able to produce the "splashy" sound discussed earlier by hitting the lower pair of cymbals with either one or two striking objects while simultaneously having the tight, dampened "chick" hi-hat sound available on upper cymbals 13 and 15 with the depression of foot pedal 45.

Referring now to FIG. 2, the simultaneous operation of upper twin cymbals 13 and 15 with lower twin cymbals 17 and 19 is accomplished by means of a pulley system, labeled with the reference 52, which is disposed within frame 25. Pulley system 52 includes a series of pulleys 53 which are disposed at spaced intervals along frame 25 as shown in FIG. 2. First and second cables 55 and 56, respectively, are attached at one end to a bracket 57 which is adjustable along the interior of shaft 35 as discussed below. Cables 55 and 56 extend around pulleys 53 to an upper rod 59 disposed at the top of frame 25. Rod 59 is biased downwardly toward the center of frame 25 by a spring 62 which is of a slightly larger diameter than rod 59 and which fits snugly around it. Spring 62 is secured at one end around the periphery of an opening 68 formed in the top of frame 25, and at the other end to a plate 58 which is secured along the upper portion of rod 59. Cables 55 and 56 attach to plate 58 on either side of rod 59 as shown in FIG. 2.

The movement of rod 59, as discussed below, is guided in part by opening 68 in frame 25. Rod 59 is of such length that when foot pedal 45 is released, the top of rod 59 just enters opening 68 and is flush with the outside top surface of frame 25. When foot pedal 45 is depressed, rod 59 moves upwardly through an opening 68 which prevents wobbling and assures smooth reciprocation of the rod 59.

Upper cymbal 15 is movably fixed to rod 59 by means of a sliding collar 65 of the type used to adjust the position of lower cymbal 17 on rod 39. A sleeve 61 having a threaded portion at its lower end is mounted to frame 25 and extends a distance along rod 59. Cymbal 13 is slid along upper rod 59 into contact with sleeve 61, and is secured thereagainst by a washer or donut 63 threaded along the lower end of sleeve 61.

Cymbals 13 and 15 clash together in response to the movement of upper rod 59, which is controlled by depressing pedal 45. As shown in FIGS. 2 and 3, and elongated slot or window 67 is formed in shaft 35 to expose the spaced bores 40 in movable rod 39. A turn key 34 extends through bracket 57 and into a selected bore 40 in rod 39 for movement therewith. As foot pedal 45 is depressed, rod 39 moves downwardly causing cymbal 17 to contact cymbal 19 of the lower twin cymbals. Simultaneously, bracket 57 moves downwardly with rod 39 pulling cables 55 and 56 downwardly therewith, thus raising upper rod 59, and cymbal 15 attached thereto, toward the top of frame 25. As mentioned above, rod 59 is guided at one end by opening 68 and at the other end by sleeve 61. As foot pedal 45 is released, spring 43 acting on rod 39 and spring 62 acting on rod 59, uncoil to return each rod to their original position. Therefore, lower cymbal 15 of the upper twin cymbals moves in unison with upper cymbal 17 of the lower twin cymbals as foot pedal 45 is depressed.

In one embodiment, collar 65 may be adjusted to secure cymbal 15 along rod 59 a space 46 from cymbal 13 which is approximately equal to the space 48 between lower twin cymbals 17 and 19. Such arrangement provides, in effect, two sets of "hi-hat" cymbals which open and close simultaneously with the depression of foot pedal 45. In an alternative embodiment, collar 65 may be adjusted along rod 59 to position cymbal 15 a greater distance from cymbal 13 than the space 48 between lower twin cymbals 17 and 19. In this instance, the percussionist is provided with a conventional hi-hat cymbal arrangement with cymbals 17 and 19, and, since upper twin cymbals 13 and 15 do not close with the depression of pedal 45, a free hanging cymbal 15 is provided within frame 25 in variable proximity above lower twin cymbals 17 and 19.

As mentioned above, the top section 24 of frame 25 is inserted within the bottom section 28 thereof, and may be adjusted to vary the distance between the upper and lower twin cymbals. Constant and uniform tension must be applied to cable 55 and 56 to enable cymbal 15 to move in unison with rod 39 and cymbal 17.

In the embodiment shown in FIG. 2, adjustment of the top section 24 within bottom section 28 of frame 25 requires a corresponding adjustment of the position of bracket 57 along rod 39 to maintain cables 55 and 56 in an extended position. If the percussionist, to attain a desired sound, adjusts the top section 24 to a position wherein the upper and lower twin cymbals are close together, bracket 57 must be moved downwardly along rod 39 by releasing turn key 34 and inserting it in a bore 40 of rod 39 where cables 55 and 56 are properly extended and tensioned to assure smooth operation and movement of upper cymbal 15 with the depression of foot pedal 45.

Figure 8:
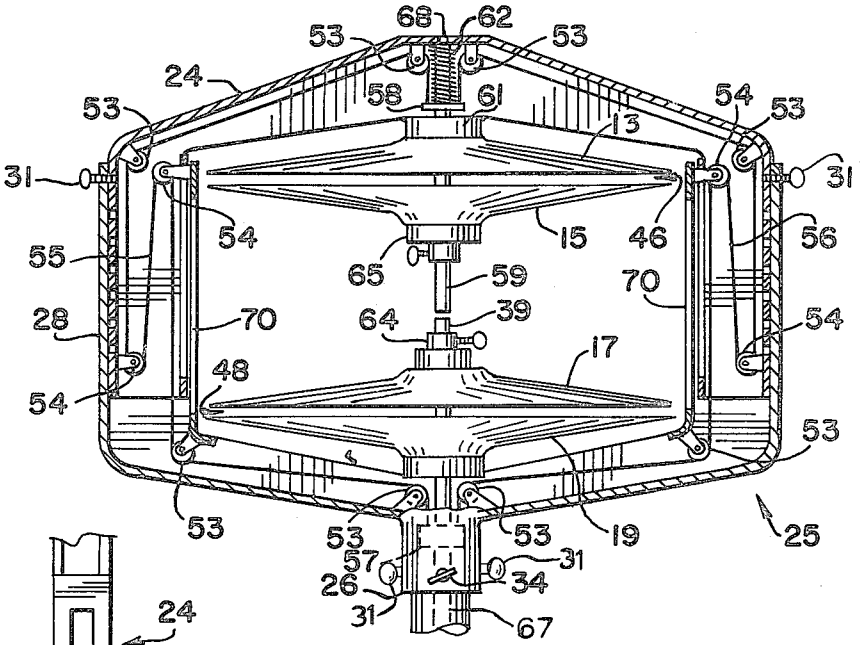
FIG. 8 is a cross-sectional view of the frame of the present invention adjusted to its minimum height showing an alternate embodiment of the cable adjustment means as in FIG. 7.
Figure 9:
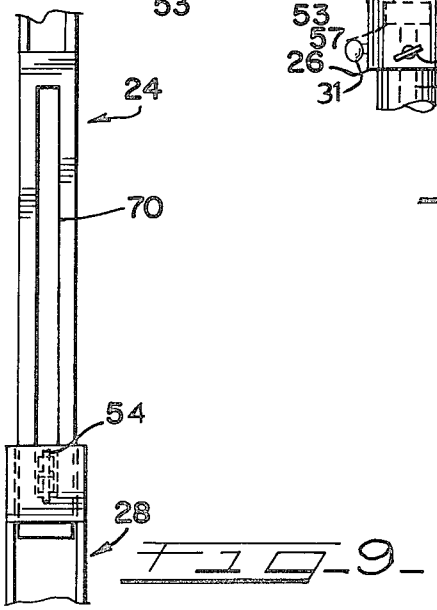
FIG. 9 is a cross-sectional view taken generally along line 9—9 of FIG. 7 showing a slotted portion formed in the top section of the frame.
Figure 7:
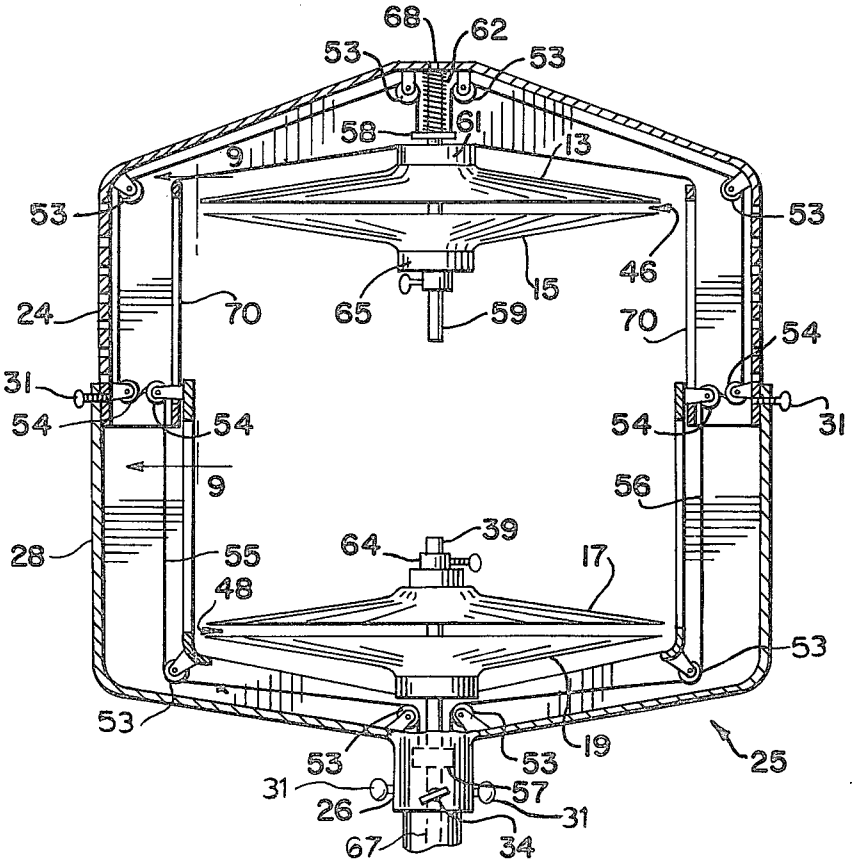
FIG. 7 is a cross-sectional view of the frame of the present invention adjusted to its maximum height showing an alternate embodiment of the cable adjustment means.

Referring to FIGS. 7, 8 and 9, an alternative embodiment is shown which assures constant, uniform tensioning of cables 55 and 56, as the relative spacing between upper and lower twin cymbals is varied, while eliminating one of the adjustment operations necessary in the embodiment of FIG. 2 discussed above. In this embodiment, two additional pulleys 54 are disposed on either side of frame 25, one being mounted near the lower open end of top section 24, and the other being mounted near the upper open end of bottom section 28. As shown in FIG. 9, top section 24 is formed with a slot 70, through which the pulley 54 mounted on bottom section 28 extends, for purposes to become apparent below.

Adjustment of the height of frame 25 by loosening screws 31 to insert top section 24 within bottom section 28 is identical to that disclosed in connection with the embodiment of FIG. 2. However, the cable tensioning means shown in FIGS. 7–9 eliminates the need to adjust the position of bracket 57 along rod 39 as discussed above, to maintain constant tension on cables 55 and 56. As shown in FIG. 8, any slack in cables 55 and 56 caused by moving top section 24 downwardly within bottom section 28 is taken up by the pulleys 54 on either side of frame 25.

As top section 24 moves downwardly, pulley 54 mounted to bottom section 28 remains stationary within slot 70. The pulley 54 moving downwardly with top section 24 forces cables 55 and 56 downwardly within bottom section 28. Cables 55 and 56 are thus tensioned between pulleys 54 on the top and bottom sections of frame 25 as the height of frame 25 is adjusted. In this embodiment, bracket 57 may remain fixed on rod 39 without loss of cable tension, which eliminates one operation of the frame height adjustment required in the embodiment of FIG. 2. This alternate cable adjustment means also allows for a much broader range of diversity in terms of hoop size versus hoop height arrangements. Due to the telescoping capabilities of rod 39 within tube 41, this embodiment would provide the drummer with the option of infinite hoop size adjustment regardless of the actual height of frame 25 in reference to collar 38 on shaft 33. In both embodiments, constant and uniform tension of cables 55 and 56 is provided to assure smooth operation of the cymbal apparatus of the present invention.

In conventional drum arrangements, various sizes and numbers of free hanging cymbals are disposed on separate stands a distance from the conventional hi-hat cymbal, requiring the drummer to reach such distances by alternately striking the hi-hat and the other cymbals. If both the traditional hi-hat and free hanging cymbals are to be struck in rapid succession or simultaneously, it may be difficult, if not impossible, for the percussionist to reach each cymbal as quickly as desired. Moreover, on existing hi-hat cymbal devices, the drummer must use both hands to produce the same number of strokes at a given speed which, by providing a striking surface at both ends of the drumsticks' range of motion, a drummer playing the present invention could duplicate with only one hand.

Additionally, as discussed above, the upper twin cymbals may be spaced apart a greater distance than the lower twin cymbals so that they will not close with the depression of the foot pedal. In this embodiment, the percussionist is provided with a free hanging cymbal within easy reach of the lower twin cymbals which operate as a conventional hi-hat.

While the invention has been described with reference to a preferred embodiment, it will be understood by those skilled in the art that various changes may be made and equivilents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A percussion musical instrument comprising:

a telescoping stand;

a frame removably mounted to said stand and movable therewith;

a spring-biased first rod disposed within said stand and movable therein;

a pair of lower twin cymbals spaced apart in a facing relationship one above the other along said first rod within said frame, the lower one of said lower twin cymbals being fixed to said frame, and the upper one of said lower twin cymbals being adjustably fixed to said first rod and movable therewith;

a second rod disposed at the top of said frame and movable therein;

a pair of upper twin cymbals spaced apart in a facing relationship one above the other along said second rod within said frame, the upper one of said upper twin cymbals being fixed to said frame, and the lower one of said upper twin cymbals being adjustably fixed to said second rod and movable therewith;

connecting means connecting said first rod to said second rod for unitary movement thereof; and, pedal means attaching to said first rod for moving said first rod up and down within said stand, said connecting means moving said second rod in unison with said first rod, whereby the upper one of said lower twin cymbals and the lower one of said upper twin cymbals move in unison with the operation of said pedal means.

2. The percussion musical instrument of claim 1 wherein said stand includes a housing held upright by a plurality of legs, and a shaft insertable within said housing, said housing having adjustment means for securing said shaft at selected positions therewithin.

3. The percussion musical instrument of claim 2 wherein said adjustment means includes a collar mounted on said housing, and a wing nut threaded through an opening in said collar into engagement with said shaft for securing said shaft at selected positions within said housing.

4. The percussion musical instrument of claim 1 further including a tube movable within said stand, said tube attaching at one end to a spring disposed in the base of said stand, and at the other end to an end of said first rod for unitary movement therewith.

5. The percussion musical instrument of claim 1 wherein said frame includes an upper section insertable within a lower section, said lower section having adjustment means to secure said upper section at selected positions therewithin for varying the distance between.

6. The percussion musical instrument of claim 5 wherein said upper section of said frame is disposed in close proximity to said lower section thereof thereby providing a short distance between said upper twin cymbals and said lower twin cymbals to permit a percussionist to alternately strike said upper and lower twin cymbals in a single, continuous motion.

7. The percussion musical instrument of claim 1 wherein said frame is formed with an opening in alignment with said second rod, said second rod extending a slight distance into said opening, said second rod being mounted to said frame in alignment with said opening by a spring disposed about the periphery of said opening, whereby as said pedal is depressed, said connecting means moves downwardly with said first rod and simultaneously moves said second rod upwardly through said opening, said opening acting as a guide for reducing wobbling of said second rod.

8. The percussion musical instrument of claim 7 wherein said spring is compressed with the depression of said pedal and the upward movement of said second rod, and uncoils with the release of said pedal to return said second rod and said connecting means to the original position.

9. A percussion musical instrument comprising:

a telescoping stand held upright by leg means, said stand being adjustable to vary the height thereof;

an adjustable frame removably mounted to said stand and movable therewith, said frame including an upper section insertable within a lower section, said lower section having adjustment means to secure said upper section at selected positions therewithin for varying the distance between said upper and lower sections;

a spring-biased first rod disposed within said stand and movable therein;

a pair of lower twin cymbals spaced apart in a facing relationship one above the other along said first rod within said frame, the lower one of said lower twin cymbals being fixed to said frame, and the upper one of said lower twin cymbals being adjustably fixed to said first rod and movable therewith;

a second rod disposed at the top of said frame and movable therein;

a pair of upper twin cymbals spaced apart in a facing relationship one above the other along said second rod within said frame, the upper one of said upper twin cymbals being fixed to said frame, and the lower one of said upper twin cymbals being adjustably fixed to said second rod and movable therewith;

connecting means connecting said first rod to said second rod for unitary movement thereof; and, pedal means attaching to said first rod for moving said first rod up and down within said second, said connecting means moving said second rod in unison with said first rod, whereby the upper one of said lower twin cymbals and the lower one of said upper twin cymbals move in unison with the operation of said pedal means.

10. The percussion musical instrument of claim 9 wherein said first rod is formed with a plurality of bores at spaced intervals therealong.

11. The percussion musical instrument of claim 10 including a bracket concentric to said first rod and movable therealong, said connecting means attaching to said bracket, said bracket having a turn key extending therethrough and being selectively insertable into said bores formed in said first rod, whereby as said upper section of said frame is moved toward said lower section thereof said bracket is secured by said turn key to a corresponding bore of said first rod to maintain said connecting means in an extended position.

12. The percussion musical instrument of claim 9 wherein said upper section of said frame is disposed in close proximity to said lower section thereof thereby providing a short distance between said upper twin cymbals and said lower twin cymbals to permit a percussionist to alternately strike said upper and lower twin cymbals in a single, continuous motion.

13. The percussion musical instrument of claim 9 wherein said frame is formed with an opening in alignment with said second rod, said second rod extending a slight distance into said opening, said second rod being mounted to said frame in alignment with said opening by a spring disposed about the periphery of said opening, whereby as said pedal is depressed, said connecting means moves downwardly with said first rod and simultaneously moves said second rod upwardly through said opening, said opening acting as a guide for reducing wobbling of said second rod.

14. The percussion musical instrument of claim 13 wherein said spring is compressed with the depression of said pedal and the upward movement of said second rod, and uncoils with the release of said pedal to return said second rod and said connecting means to the original position.

15. The percussion musical instrument of claim 9 wherein said connecting means includes a plurality of pulleys mounted at spaced intervals along the periphery of said upper section and said lower section of said adjustable frame, and cables extending around the periphery of said frame through each of said pulleys, said cables connecting at one end to said first rod and at the other end to said second rod for unitary movement of said first and second rods with the operation of said pedal means.

16. The percussion musical instrument of claim 15 further including an elongated slot formed in said upper section of said frame, wherein a first one of said pulleys is mounted adjacent the upper portion of said lower section and extends through said slot, and a second one of said pulleys is mounted adjacent the lower portion of said upper section such that said cable extends between said first and second pulleys, whereby as said upper section moves downwardly within said lower section said first and second pulleys cooperate to maintain tension on said cable extending therebetween.

17. A percussion musical instrument comprising:

a stand having a housing held upright by legs, and a shaft insertable into said housing and movable therewithin;

an adjustable frame removably mounted to said shaft of said stand and movable therewith for adjusting the height of said frame;

a tube movable within said housing, said tube being biased upwardly by a spring disposed at the base of said housing;

a first rod disposed within said leg and extending upwardly within said frame, said first rod attaching to said tube for movement therewith;

a pair of lower twin cymbals spaced apart in a facing relationship one above the other along said first rod within said frame, the lower one of said lower twin cymbals being fixed to said frame, and the upper one of said lower twin cymbals being adjustably fixed to said first rod and movable therewith;

a spring biased second rod disposed at the top of said frame and movable therein;

a pair of upper twin cymbals spaced apart in a facing relationship one above the other along said second rod within said frame, the upper one of said upper twin cymbals being fixed to said frame, and the lower one of said upper twin cymbals being adjustably fixed to said second rod and movable therewith;

pulley means mounted to said frame, said pulley means including cables connecting at one end to said first rod and at the other end to said second rod for unitary movement thereof;

a pedal attached to said tube and movable to reciprocate said tube and said first rod attached thereto up and down within said stand, whereby as said pedal is depressed said first rod and said second rod travel in unison to simultaneously move the lower one of said upper twin cymbals into contact with the upper fixed cymbal thereof, and the upper one of said lower twin cymbals into contact with the lower fixed cymbal thereof.

18. The percussion musical instrument of claim 17 wherein said pulley means include a plurality of pulleys disposed at spaced intervals along the periphery of said frame, said cables attaching at one end to said first rod and extending around said pulleys to attach at the other end to said second rod for unitary movement of said second rod with said first rod.

19. The percussion musical instrument of claim 17 wherein said frame includes an upper section insertable within a lower section, said lower section having adjustment means to secure said upper section at selected positions therewithin, whereby said upper section is inserted downwardly within said lower section to move said upper twin cymbals a short distance above said lower twin cymbals to permit a percussionist to alternately strike said upper and lower twin cymbals in a single, continuous motion.

20. The percussion musical instrument of claim 17 wherein said frame is formed with an opening in alignment with said second rod, said second rod extending a slight distance into said opening, said second rod being mounted to said frame in alignment with said opening by a spring disposed about the periphery of said opening, whereby as said pedal is depressed, said cables move downwardly with said first rod and simultaneously move said second rod upwardly through said opening, said opening acting as a guide for reducing wobbling of said second rod.

21. The percussion musical instrument of claim 17 wherein said spring is compressed with the depression of said pedal and the upward movement of said second rod, and uncoils with the release of said pedal to return said second rod and said cables to their original position.

22. A percussion musical instrument comprising:

a telescoping stand held upright by leg means, said stand being adjustable to vary the height thereof;

a frame removably mounted to said stand and movable therewith;

a spring-biased first rod disposed within said stand and movable therein;

a pair of lower twin cymbals spaced a first distance apart in a facing relationship one above the other within said frame, the lower one of said lower twin cymbals being fixed to said frame, and the upper one of said lower twin cymbals being adjustably fixed to said first rod and movable therewith;

spring-biased second rod disposed within said frame and movable therein;

a pair of upper twin cymbals spaced a second distance apart in a facing relationship one above the other within said frame, said second distance being substantially equal to said first distance, the lower one of said upper twin cymbals being adjustably fixed to said second rod and movable therewith;

pedal means attaching to said first rod, said pedal means being movable to reciprocate said first rod upwardly and downwardly within said stand, said connecting means moving said second rod within said frame in unison with said first rod, whereby as said pedal means is depressed the upper one of said lower twin cymbals moves said first distance to contact the lower fixed cymbal thereof, and simultaneously the lower one of said upper twin cymbals moves said second distance to contact the upper fixed cymbal thereof.

23. The percussion musical instrument of claim 22 including a collar removably mounted to said second rod, said collar supporting said lower one of said upper twin cymbals and being adjustable to dispose said lower one at selected positions along said second rod to vary said second distance between said upper twin cymbals.

24. A percussion musical instrument comprising:

a telescoping stand held upright by leg means, said stand being adjustable to vary the height thereof;

a frame removably mounted to said stand and movable therewith;

a spring-biased rod disposed within said stand and movable therein;

a pair of lower twin cymbals spaced a first distance apart in a facing relationship one above the other within said frame, the lower one of said lower twin cymbals being fixed to said frame, and the upper one of said lower twin cymbals being adjustably fixed to said first rod and movable therewith;

a pair of upper twin cymbals spaced a second distance apart in a facing relationship one above the other within said frame, said second distance being greater than said first distance, the lower one of said upper twin cymbals being adjustably fixed to said second rod and movable therewith;

pedal means attaching to said first rod and being movable to reciprocate said rod up and down within said stand, said connecting means moving said second rod in unison with said first rod, whereby said upper one of said lower twin cymbals and said lower one of said upper twin cymbals move in unison with said first rod and said second rod respectively, said upper one of said lower twin cymbals moving said first distance to contact the fixed cymbal of said lower twin cymbals, while said lower one of said upper twin cymbals simultaneously moves said second distance to a point adjacent the fixed cymbal of said upper twin cymbals.

25. The percussion musical instrument of claim 24 including a collar removably mounted to said second rod, said collar supporting said lower one of said upper twin cymbals and being adjustable to dispose said lower one at selected positions along said second rod to vary said second distance between said upper twin cymbals.

* * * * *